US007804260B2

(12) United States Patent
Deurenberg

(10) Patent No.: US 7,804,260 B2
(45) Date of Patent: Sep. 28, 2010

(54) LED LUMINARY SYSTEM

(75) Inventor: Peter Hubertus Franciscus Deurenberg, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 250 days.

(21) Appl. No.: 12/091,108

(22) PCT Filed: Oct. 16, 2006

(86) PCT No.: PCT/IB2006/053794

§ 371 (c)(1),
(2), (4) Date: Apr. 22, 2008

(87) PCT Pub. No.: WO2007/049180

PCT Pub. Date: May 3, 2007

(65) Prior Publication Data

US 2008/0246419 A1 Oct. 9, 2008

(30) Foreign Application Priority Data

Oct. 26, 2005 (EP) ..... 05109999

(51) Int. Cl.
*H05B 37/02* (2006.01)

(52) U.S. Cl. ..... 315/307; 315/308; 315/305

(58) Field of Classification Search ..... 315/291, 315/224, 307, 308, 309, 310, 149, 156–159
See application file for complete search history.

(56) References Cited

U.S. PATENT DOCUMENTS 6,411,046 B1 6/2002 Muthu
7,504,781 B2 * 3/2009 Wendt et al. ..... 315/291
2002/0097000 A1 7/2002 Muthu et al.

FOREIGN PATENT DOCUMENTS

EP 1662583 A1 5/2006
WO WO0247438 A2 6/2002
WO WO2005021323 A2 3/2005

OTHER PUBLICATIONS

Deurenberg et al: "Achieving Color Point Stability in RGB Multi-Chip LED Modules Using Various Color Control Loops"; Proceedings of the SPIE, vol. 5941, (59410C-1), Sep. 2005, pp. 1-12.

(Continued)

*Primary Examiner*—David Hung Vu

(57) ABSTRACT

The present invention relates to a light emitting diode (LED) luminary system (10) comprising a plurality of LED light sources (14) of multiple colors for producing a mixed color light, and means (28) for controlling the LED light sources in accordance with differences between set point values representing a mixed color light having a desired color and first control data representing the color of the mixed color light produced by the LED light sources, the first control data being provided by at least one color sensor (22). The system is characterized by means (30, 32) for deriving the temperature of each LED light source, and means (26) for compensating the set point values in accordance with second control data including the LED light source temperatures. This offers increased color stability for the system. The invention also relates to a method and system for controlling a LED luminary.

20 Claims, 1 Drawing Sheet

OTHER PUBLICATIONS

Figure 1:
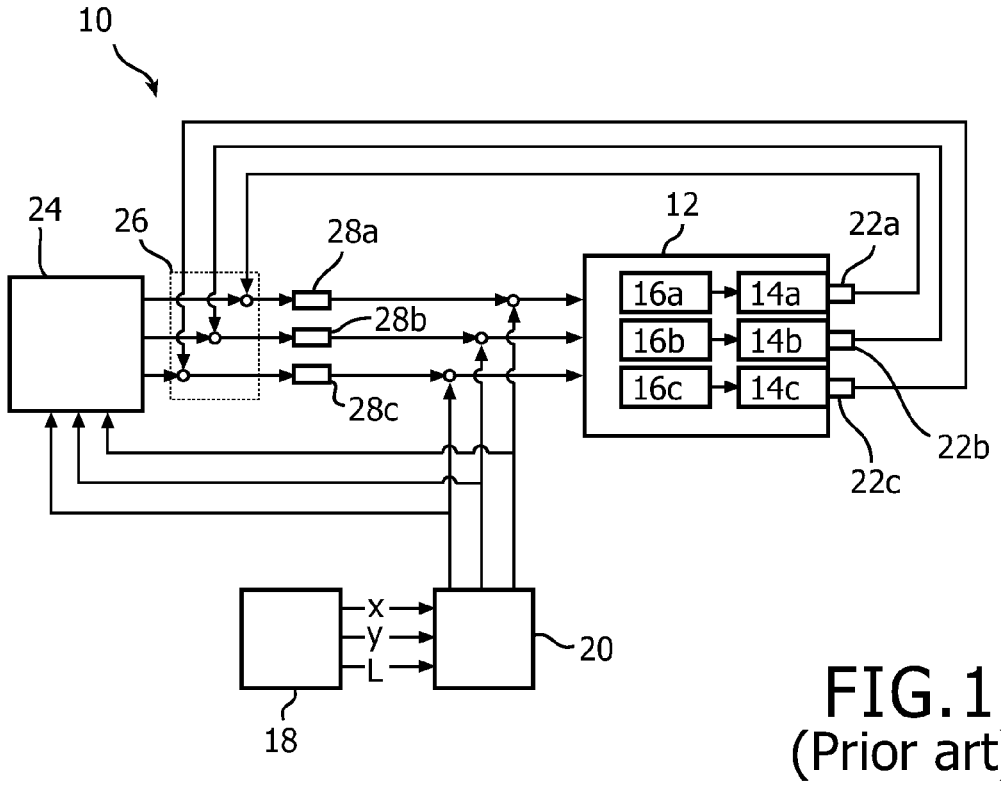
FIG.1 (Prior art)

Muthu et al: "Red, Green and Blue LED Based White Light Generation: Issues and Control"; Proceedings of 2002 IEEE Industry Applications Society Annual Meeting, Oct. 13-18, 2002, Pittsburgh, PA., pp. 327-333.

Muthu et al: "Red, Green, and Blue LEDs for White Light Illumination"; IEEE Journal of Selected Topics in Quantum Electronics, Mar.-Apr. 2002, pp. 333-338.

* cited by examiner

LED LUMINARY SYSTEM

The present invention relates to a light emitting diode (LED) luminary system comprising a plurality of LED light sources of multiple colors for producing a mixed color light. The invention also relates to a control method and system for an LED luminary.

Mixing multiple colored LEDs to obtain a mixed color is a common way to generate white or colored light. The generated light is determined by a number of parameters, for instance the type of LEDs used, the color ratios, the driving ratios, the mixing ratios, etc. However, the optical characteristics of the LEDs change when the LEDs rise in temperature during operation: the flux output decreases and the peak wavelength shifts.

To overcome or alleviate this problem, various color control systems have been proposed in order to compensate for these changes in optical characteristics of the LEDs during use. Examples of color control systems or algorithms include color coordinates feedback (CCFB), temperature feed forward (TFF), flux feedback (FFB), or a combination of the last two (FFB+TFF), as disclosed in for example in the publication "Achieving color point stability in RGB multi-chip LED modules using various color control loops", P. Deurenberg et al., Proc. SPIE Vol. 5941, 59410C (Sep. 7, 2005).

In CCFB, filtered photodiodes are used to feed back the color coordinates of the actual mixed color light, which color coordinates are compared to reference or set point values representing a desired mixed color light. The LEDs are then controlled in accordance with the derived differences.

Such a feedback system is thought to be able to robustly compensate for temperature effects is all LED systems. However, recent measurements show that this is not true for every LED and sensor combination. In fact, certain combinations lead to very unstable color output only slightly better than without compensation. An underlying reason for this incorrect reaction of the feedback system is that there can be a mismatch between sensor sensitivity and human eye sensitivity. That is, the color sensitivity of the sensor does not match the sensitivity of the human eye. This means that the feedback system will accurately maintain the light output in the sensor domain, but not in the human domain. If the LEDs would emit light with a constant wavelength, it would be easy to compensate for the difference in sensor sensitivity and eye sensitivity. However, the mismatch between sensor and eye sensitivity is different for different wavelengths, and additionally the LEDs' peak wavelength increases for rising temperatures. Especially in LED wavelength ranges where, for increasing wavelengths, the eye sensitivity increases, but the sensor sensitivity decreases, this mismatch amplifies and results in large color point differences.

It is an object of the present invention to overcome this problem, and to provide an improved, more color stable LED luminary system.

This and other objects that will be evident from the following description are achieved by means of a LED luminary system, and a method and system for controlling a LED luminary, according to the appended claims.

According to an aspect of the invention, there is provided an LED luminary system comprising a plurality of LED light sources of multiple colors for producing a mixed color light, and means for controlling the LED light sources in accordance with differences between set point values representing a mixed color light having a desired color and first control data representing the color of the mixed color light produced by the LED light sources, the first control data being provided by at least one color sensor, the LED luminary system being characterized by means for deriving the temperature of each LED light source, and means for compensating the set point values in accordance with second control data including the LED light source temperatures.

By compensating each set point value in accordance with the temperature of the corresponding LED light source, it is possible to account for the peak wavelength shifts as the temperature of the LED light sources changes, whereby a more color stable and robust LED luminary system is achieved.

It should be noted that an example of accounting for temperature changes in a LED luminary system with CCFB type functionality is known from the document "Red, Green, and Blue LED based white light generation: Issues and control", Muthu et al. (2002), wherein the gain of the feedback signals is corrected with respect to heat sink temperature (in order to account for temperature changes). This should be contrasted to the system according to the invention wherein the signals themselves are not adjusted, but the set point values to which the feedback signals are compared. Further, the system disclosed in the above mentioned document is setup in the human domain, whereas the system according to the invention is setup in the sensor domain.

Preferably, the second control data further includes a reference LED light source temperature for each LED light source, whereby the difference between the derived LED light source temperature and the reference LED light source temperature is a measure of the amount of peak wavelength shift for the LED light source. As the shift is constant over a large temperature range, the current peak wavelength can be estimated, whereby this information is used to adjust the set point values.

The second control data further preferably includes data describing the sensitivity of the sensor(s) for different peak wavelengths, as well as data describing the LED light source spectra, based on which the set point values can be adjusted accordingly.

In order to derive the temperature of each LED light source, the derive means can comprises a temperature sensor adapted to measure the temperature of a heat sink accommodating the LED light sources. In one embodiment, the derive means further comprises means for calculating the LED light source temperatures based on at least the measured heat sink temperature and a thermal model of the plurality of LED light sources.

Further, the at least one color sensor can be filtered photodiodes, preferably one sensor for each LED light source color, in order to detect the color of the light generated by the LED light sources.

According to another aspect of the invention, there is provided a method for controlling a LED luminary including a plurality of LED light sources of multiple colors for producing a mixed color light, the method comprising controlling the LED light sources in accordance with differences between set point values representing a mixed color light having a desired color and first control data representing the color of the mixed color light produced by the LED light sources, the first control data being provided by at least one color sensor, the method being characterized by deriving the temperature of each LED light source, and compensating the set point values in accordance with second control data including the LED light source temperatures. This method offers similar advantages as obtained with the previously discussed aspect of the invention.

According to yet another aspect of the invention, there is provided a system for controlling a LED luminary including a plurality of LED light sources of multiple colors for producing a mixed color light, the system comprising means for controlling the LED light sources in accordance with differences between set point values representing a mixed color light having a desired color and first control data representing the color of the mixed color light produced by the LED light sources, the first control data being provided by at least one color sensor, the system being characterized by means for deriving the temperature of each LED light source, and means for compensating the set point values in accordance with second control data including the LED light source temperatures. This control system offers similar advantages as obtained with the previously discussed aspects of the invention.

These and other aspects of the present invention will now be described in more detail, with reference to the appended drawings showing a currently preferred embodiment of the invention.

Figure 2:
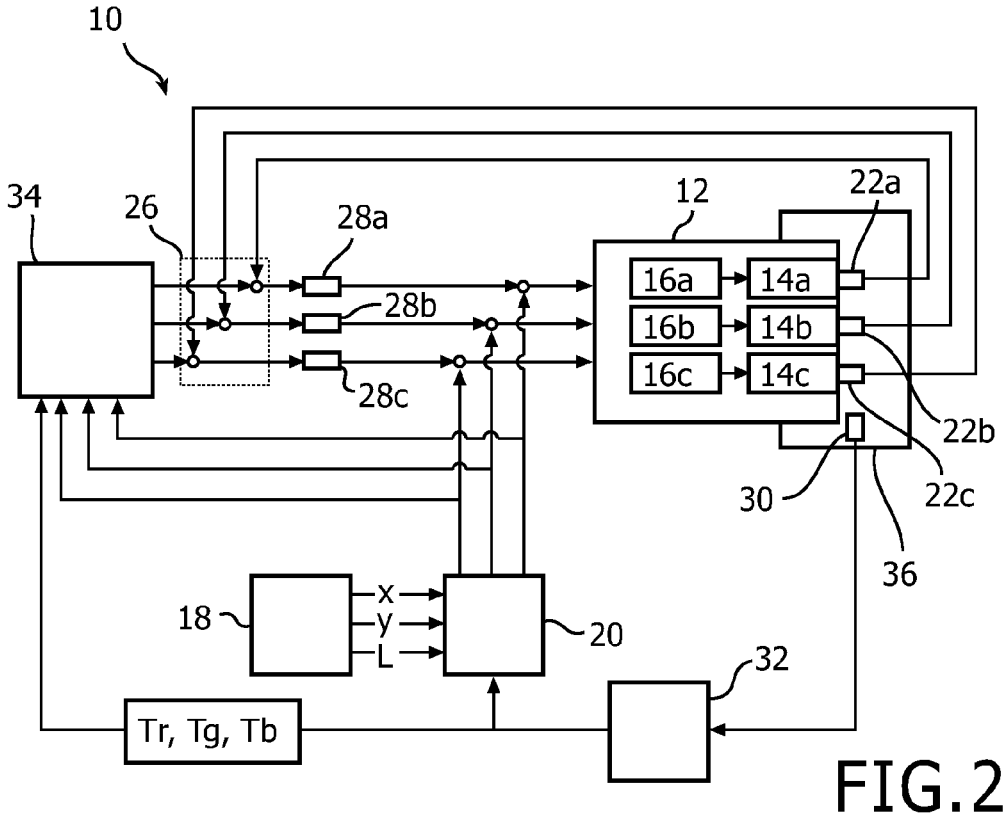

FIG. 1 is a block diagram of a LED luminary system with CCFB functionality according to prior art, and FIG. 2 is a block diagram showing a LED luminary system according to an embodiment of the invention.

FIG. 1 is a block diagram of a prior art LED luminary system 10. A LED luminary system of this type is disclosed in for example the above mentioned publication "Achieving color point stability in RGB multi-chip LED modules using various color control loops", P. Deurenberg et al., Proc. SPIE Vol. 5941, 59410C (Sep. 7, 2005).

The LED luminary system 10 comprises a LED luminary 12, which in turn comprises one LED light source 14*a* including LEDs adapted to emit red light, one LED light source 14*b* including LEDs adapted to emit green light, and one LED light source 14*c* including LEDs adapted to emit blue light. Each LED light source 14 is connected to a corresponding driver 16 for driving the LED light source. The LED luminary system 10 can for instance produce white light by mixing the output of the different LED light sources 14, and it can be used for illumination or lighting purposes. Also, the LED luminary system 10 can be a variable color LED luminary system.

The LED luminary system 10 further comprises a user interface 18 and a calibration matrix 20. A user input indicating a desired lumen output and color of the LED luminary 12 is received through the user interface 18. The user input can for example be specified in CIE x, y, L representing a certain position (color point) in the CIE 1931 chromaticity diagram. The user input is transferred to the calibration matrix 20, which calculates the nominal duty cycles for each color R, G, B for the chosen color point (i.e. the user input in converted from the user domain to the actuator domain).

In order to implement color coordinates feedback functionality, the LED luminary system 10 further comprises three-color sensors 22*a*-22*c*, a color reference block 24, a comparison block 26, and PID (proportional-integral-derivative) controllers 28*a*-28*c*.

Each sensor 22*a*-22*c* is associated with a corresponding LED light source 14*a*-14*c*. Thus, sensor 22*a* is adapted to detect red light, sensor 22*b* is adapted to detect green light, and sensor 22*c* is adapted to detect blue light. The color sensors 22 can for example be filtered photodiodes.

Upon operation of the LED luminary system 10, the sensors 22 convert the mixed color light produced by the LED luminary 12 into three sensor values or feedback values (first control data) corresponding to red, green and blue, respectively. The sensor values are in the sensor domain.

These sensor values (representing actual color) are subsequently compared to set point values (representing a desired color) provided by the color reference block 28, which in turn calculated these set point values based on input from the calibration matrix 20. That is, the reference block 28 converts the nominal duty cycles (in the actuator domain) from the calibration matrix 20 to set point values (in the sensor domain) at a certain reference temperature. The set point values are compared to the corresponding feedback values for each color in the comparison block 26, and the resulting differences for each color R, G, B are passed on to the PID controllers 28. The PID controllers 28 in turn modify the inputs, which are provided to the LED drivers 16*a*-16*c*, in accordance with the derived differences. This adjusts the red, green and blue LED light sources 14*a*-14*c* so that the desired color is output from the LED luminary 12 (i.e. so that the error between the set point values and the feedback values reach zero under steady-state conditions). It should be noted that before being passed to the LED luminary, the outputs of the PID controllers are converted from the sensor domain to the actuator domain (duty cycles) and multiplied with the outputs from the calibration matrix (i.e. the nominal duty cycles). As mentioned above, the CCFB functionality can improve the color stability of the LED luminary system, however not for every LED-sensor combination.

FIG. 2 is a block diagram of a LED luminary system according to an embodiment of the present invention. A difference between the prior art system of FIG. 1 and the system of FIG. 2 is that the LED luminary system 10 of FIG. 2 additionally further comprises temperature feed forward functionality (TFF), in order to further increase the color stability. The TFF functionality is here implemented by a temperature sensor 30, a calculation block 32, and a reference block 34.

The temperature sensor 30 is mounted on a heat sink 36, which heat sink 36 also accommodates the LED light sources 14. Upon operation, the temperature sensor 30 measures the temperature of the heat sink. The temperature measurement is then passed onto the calculation block 32, which based on the heat sink temperature together with a thermal model of the LED light sources and the electrical current input to the LED light sources calculates the temperature (namely the junction temperature) for each LED light source 14*a*-14*c*. The junction temperature is the temperature of the active layer inside the LED.

The junction temperature data ($T_{red}$, $T_{green}$, and $T_{blue}$) is then passed to the reference block 34. As the reference block 24 of FIG. 1, the reference block 34 of FIG. 2 comprises set point values calculated based on input from the calibration matrix 20. Additionally, the reference block 34 comprises a reference junction temperature for each LED light source 14, whereby the difference of the current junction temperature and the reference junction temperature is a measure for the amount of peak wavelength shift. As this shift is constant over a large temperature range, the current peak wavelength for each LED light source can be estimated.

This information (second control data) is then used in block 34 to compensate the set point values, in order to account for the peak wavelength shifts as the temperature of the LED light sources changes. That is, the set point values are re-calculated for the currently estimated peak wavelength. This re-calculation requires, for each LED light source color, the peak wavelength shift, data concerning the sensor sensitivity and LED light source spectrum, an estimate of the peak wavelength at reference temperature, and a thermal model of the system. Thus, when the set point values representing a desired output of the LED luminary 12 are compared to the actual output of the LED luminary in comparison block 26, the set point values are already compensated with respect to the peak wavelength shift of the LED light sources 14.

It should be noted that this compensation should also be applied when converting from the sensor domain to the actuator domain (i.e. between the PID controllers and the LED luminary), however, using an inverted version. Further, the temperatures from the calculation block 32 are also passed to the calibration matrix 20 to account for the peak wavelength shifts.

Thus, the LED luminary system according to the current embodiment of the invention uses a color control algorithm including both CCFB and TFF. As mention above, such compensation results in a more color stable LED luminary system. When the CCFB+TFF color control algorithm is applied to a RGB LED luminary system (as above), the color stability increases about 2 points compared to a system where only CCFB is used, as indicate in Table 1 below. The increase is even more significant for an AGB LED luminary system, where the CCFB+TFF color control algorithm increases the color stability by 24 points compared to the CCFB color control algorithm.

TABLE 1

Color stability for RGB and AGB LED systems.

| Δu'v' (ΔT = 73K) | RGB LED system | AGB LED system |
|---|---|---|
| CCFB | 0.008 | 0.030 |
| CCFB+TFF | 0.006 | 0.006 |

The person skilled in the art realizes that the present invention by no means is limited to the preferred embodiments described above. On the contrary, many modifications and variations are possible within the scope of the appended claims. For example, the system and method according to the invention can be used for different LED combinations, such as RGB, AGB, RAGB, phosphor converted LED systems, etc.

The invention claimed is:

1. A light emitting diode (LED) luminary system comprising:

a plurality of LED light sources of multiple colors for producing a mixed color light; and means for controlling the LED light sources in accordance with differences between set point values representing a mixed color light having a desired color and first control data representing the color of the mixed color light produced by said LED light sources, said first control data being provided by at least one color sensor;

means for deriving the temperature of each LED light source; and means for compensating said set point values in accordance with second control data including said LED light source temperatures.

2. A system according to claim 1, wherein said second control data further includes a reference LED light source temperature for each LED light source, whereby the difference between said LED light source temperature and said reference LED light source temperature is a measure of the amount of peak wavelength shift for the LED light source.

3. A system according to claim 1, wherein said second control data further includes data describing the sensitivity of the at least one color sensor for different peak wavelengths.

4. A system according to claim 1, wherein said second control data further includes data describing the spectral outputs of the LED light sources.

5. A system according to claim 1, wherein said means for deriving comprises a temperature sensor adapted to measure the temperature of a heat sink accommodating said LED light sources.

6. A system according to claim 5, wherein said means for deriving further comprises means for calculating a junction temperature of each LED light source based on at least the measured heat sink temperature and a thermal model of the plurality of LED light sources.

7. A system according to claim 1, wherein said at least one color sensor includes at least one color filtered photodiode.

8. A method for controlling an LED luminary including a plurality of LED light sources of multiple colors for producing a mixed color light, the method comprising:

controlling the LED light sources in accordance with differences between set point values for said LED light sources representing a mixed color light having a desired color and first control data representing the color of the mixed color light produced by said LED light sources, said first control data being provided by at least one color sensor;

deriving the temperature of each LED light source; and compensating said set point values in accordance with second control data including said LED light source temperatures.

9. A system for controlling an LED luminary including a plurality of LED light sources of multiple colors for producing a mixed color light, which system comprises:

means for controlling the LED light sources in accordance with differences between set point values for the LED light sources representing a mixed color light having a desired color and first control data representing the color of the mixed color light produced by said LED light sources, said first control data being provided by at least one color sensor;

means for deriving the temperature of each LED light source, and means for compensating said set point values in accordance with second control data including said LED light source temperatures.

10. The system of claim 1, wherein the plurality of LED light sources includes at least one LED light source outputting light having a first color, at least one LED light source outputting light having a second color, and at least one LED light source outputting light having a third color, and wherein the first control data is provided by a plurality of color sensors each corresponding to one of the first, second, and third colors.

11. The system of claim 10, further comprising a calibration matrix configured to calculate nominal duty cycles for each of the first, second and third colors, and wherein the means for compensating the set point values in accordance with the second control data includes a reference block generating the set point values based on the calculated nominal duty cycles, the reference block having a reference junction temperature for each LED light source and being configured to temperature compensate the set points values in accordance with a difference between the derived temperature of each LED light source and the reference temperature of each LED light source.

12. The system of claim 11, wherein the means for controlling the LED light sources comprises comparators each comparing one of the temperature compensated set point values to an output of one of the color sensors and outputting a difference signal.

13. The system of claim 12, further comprising a plurality of proportional-integral-derivative (PID) controllers each corresponding to one of the colors and each receiving one of the difference signals and in response thereto outputting a signal for controlling one of the LED light sources.

14. The system of claim 13, further comprising comparators for comparing adjusting a duty cycle of each of the signals output by the PID controllers with a corresponding one of the nominal duty cycles from the calibration matrix.

15. The method of claim 8, wherein the plurality of LED light sources includes at least one LED light source outputting light having a first color, at least one LED light source outputting light having a second color, and at least one LED light source outputting light having a third color, and wherein the first control data is provided by a plurality of color sensors each corresponding to one of the first, second, and third colors, the method further comprising:

calculating nominal duty cycles for each of the first, second and third colors, and wherein compensating the set point values in accordance with the second control data includes generating the set point values based on the calculated nominal duty cycles, and temperature compensating the set points values in accordance with a difference between the derived temperature of each LED light source and a reference temperature of each LED light source.

16. The method of claim 15, further comprising comparing each one of the temperature compensated set point values to an output of one of the color sensors and outputting a corresponding plurality of difference signals.

17. The system of claim 9, wherein the plurality of LED light sources includes at least one LED light source outputting light having a first color, at least one LED light source outputting light having a second color, and at least one LED light source outputting light having a third color, and wherein the first control data is provided by a plurality of color sensors each corresponding to one of the first, second, and third colors, the system further comprising:

a calibration matrix configured to calculate nominal duty cycles for each of the first, second and third colors, and wherein the means for compensating the set point values in accordance with the second control data includes a reference block generating the set point values based on the calculated nominal duty cycles, the reference block having a reference junction temperature for each LED light source and being configured to temperature compensate the set points values in accordance with a difference between the derived temperature of each LED light source and the reference temperature of each LED light source.

18. The system of claim 17, wherein the means for controlling the LED light sources comprises comparators each comparing one of the temperature compensated set point values to an output of one of the color sensors and outputting a difference signal.

19. The system of claim 18, further comprising a plurality of proportional-integral-derivative (PID) controllers each corresponding to one of the colors and each receiving one of the difference signals and in response thereto outputting a signal for controlling one of the LED light sources.

20. The system of claim 19, further comprising comparators for comparing a duty cycle of each of the signals output by the PID controllers with a corresponding one of the nominal duty cycles from the calibration matrix.

* * * * *